US007409847B2

(12) United States Patent
Wightman et al.

(10) Patent No.: US 7,409,847 B2
(45) Date of Patent: Aug. 12, 2008

(54) METHOD AND APPARATUS FOR SECURING CONNECTING FERRULES

(75) Inventors: William A. Wightman, Newalla, OK (US); James C. Clingerman, Oklahoma City, OK (US)

(73) Assignee: Intelligent Design Group, Inc., Newalla, OK (US)

( * ) Notice: Subject to any disclaimer, the term of this patent is extended or adjusted under 35 U.S.C. 154(b) by 105 days.

(21) Appl. No.: 11/638,874

(22) Filed: Dec. 14, 2006

(65) Prior Publication Data

US 2008/0141753 A1 Jun. 19, 2008

(51) Int. Cl.
*B21D 37/10* (2006.01)
*B21D 39/04* (2006.01)
*H01R 43/048* (2006.01)

(52) U.S. Cl. ..... 72/416; 72/370.25; 72/411; 29/753; 29/283.5; 29/517

(58) Field of Classification Search ..... 72/416, 72/402, 411, 370.12, 370.13, 370.25; 29/751, 29/753, 237, 282, 283.5, 516, 517
See application file for complete search history.

(56) References Cited

U.S. PATENT DOCUMENTS 1,319,837 A * 10/1919 Brinkman ..... 72/370.25
2,557,126 A 6/1951 Macy
3,010,183 A 11/1961 Forney, Jr.
3,098,517 A 7/1963 Zell et al.
3,146,519 A 9/1964 Redwine
3,228,228 A * 1/1966 Myotte ..... 72/402
3,412,596 A 11/1968 Burns
3,417,599 A 12/1968 Burns
3,436,949 A * 4/1969 Mitchell et al. ..... 72/402
3,869,776 A * 3/1975 Moshnin et al. ..... 29/890.149
4,976,132 A 12/1990 Shaffer
4,991,289 A 2/1991 French
5,490,406 A 2/1996 College
6,098,443 A 8/2000 Müller et al.
6,193,138 B1 2/2001 Wada
6,449,841 B1 9/2002 Endo et al.
6,880,240 B2 4/2005 Kitagawa et al.

* cited by examiner

*Primary Examiner*—Daniel C Crane
(74) *Attorney, Agent, or Firm*—Dunlap Codding, P.C.

(57) ABSTRACT

A ferrule securing assembly including a die set assembly for reducing a cylindrical ferrule. The die set assembly having a female die and a male die. The female die having a female die opening sequentially defined by a tapered section, a parallel section, and a concave seat. The male die having a concave die face with at least two lateral edges, a medial area, and a radius of curvature. The male die is receivable in the female die opening to move the ferrule through the tapered section so as to forge the ferrule into a substantially oval shape, to move the oval shaped ferrule through the parallel section, and to compress the oval shaped ferrule between the concave die face and the concave seat to forge the oval shaped ferrule into a substantially cylindrical shape. The radius of curvature of the concave die face being greater than the radius of curvature of the concave seat such that contact between the ferrule and the concave die face is shifted from the lateral edges of the concave die face to the medial area of the concave die face as the ferrule is moved through the tapered section.

20 Claims, 6 Drawing Sheets

METHOD AND APPARATUS FOR SECURING CONNECTING FERRULES

BACKGROUND OF THE INVENTION

1. Field of the Invention

The present invention relates generally to a method and apparatus for securing a connector employing a connecting body such as a ferrule over an inner member such as a wire. The present invention also has general application in making mechanically secure connections using connectors having a connecting body requiring shrinkage or mechanical deformation to be secured over an inner load carrying member, such as a guy wire or support cable. More specifically, but not by way of limitation, the present invention is directed to a method and apparatus for connecting ferrules such that the connected ferrule is substantially circular in shape but with sufficiently reduced cross-sectional area so as to achieve a circumferentially tight fit around the inner members.

2. Brief Description of Related Art

The field of wire termination utilizes a number of common practices to achieve electrically and mechanically efficient connections. In general, these practices involve some form of asymmetric deformation of a terminal ferrule around a group of wires. Prior art publications teach various forms of indentation of the ferrule, a general flattening of the ferrule, or a creasing, piercing, or buckling of the ferrule wall onto the inner members. The aforementioned methods create sharp and inconsistent deformations, indentations, and creases in the ferrule. In addition, the non-uniform shape of the reduced terminal creates voids between the terminal and the wires leading to possible fouling and corrosion from moisture migration into the voids. Still yet, the unpredictable variations formed by these methods of deformation create connections with equally unpredictable and inferior mechanical strength. Less common and more exotic methods do achieve symmetric connections such as hexagonal or square shapes, but still do not achieve finished connections having a substantially circular cross-section and thus suffer from the aforementioned problems to some degree.

It is more desirable to drive the finished ferrule into a near-circular shape. A number of advantages are achieved over methods using simple physical deformation to connect the ferrule. These advantages include excellent mechanical security and electrical conductivity; consistent mechanical pressure across the inner cross-section of the connection; an attractive appearance; no distress on inner wires or cable strands; no bending, cracking, tearing or piercing of ferrule walls; no exposed sharp edges of the ferrule to snag or foul in assembly; thickening and strengthening of the wall of the connected ferrule; and elimination of voids or gaps in the captured wire or cable thus removing points of entry for corrosive chemicals, liquids or gases.

U.S. Pat. No. 3,010,183, issued to E. W. Forney, Jr., on Nov. 28, 1961, discloses a crimping method in which a terminal ferrule is reduced in cross-sectional area without material change to its shape. The Forney patent further teaches a die set comprising a male die and a female die. The female die provides a die opening enlarged at its upper end and sharply tapering to a parallel section rounded at its lower end. The male die provides a curved surface of substantially the same radius of curvature as the rounded section at the bottom of the female die.

The method and apparatus of the Forney patent is fundamentally flawed in that the curved portions of the male and female dies have substantially equal radii of curvature. Using substantially equal radii of curvature introduce point loads and shear stresses between the lateral edges of the male die's curved face and the ferrule, such that the ferrule is sharply deformed at these points of contact as it is pushed into the opening of the female die. The point loads and shear stresses introduced by the apparatus of the Forney patent create sharp indentations and protrusions, materially changing the shape of the ferrule such that the smoothness and continuity of the outer surface is sacrificed. Using a substantially equal radius in the male die also creates extremely thin and fragile lateral edges along the width of the upper die. Exposing these edges to the forming pressures between the dies will cause them to break down and fail. In addition, the Forney patent diagrams a sharp transition within the tapering portion of the female die. It has been found in practice that pressing a ferrule into such a sharply tapering transition will cause it to bind and effectively jam the mechanism, damage the ferrule, and result in a failure to complete the forming process.

DETAILED DESCRIPTION OF EXEMPLARY EMBODIMENT

Figure 1:
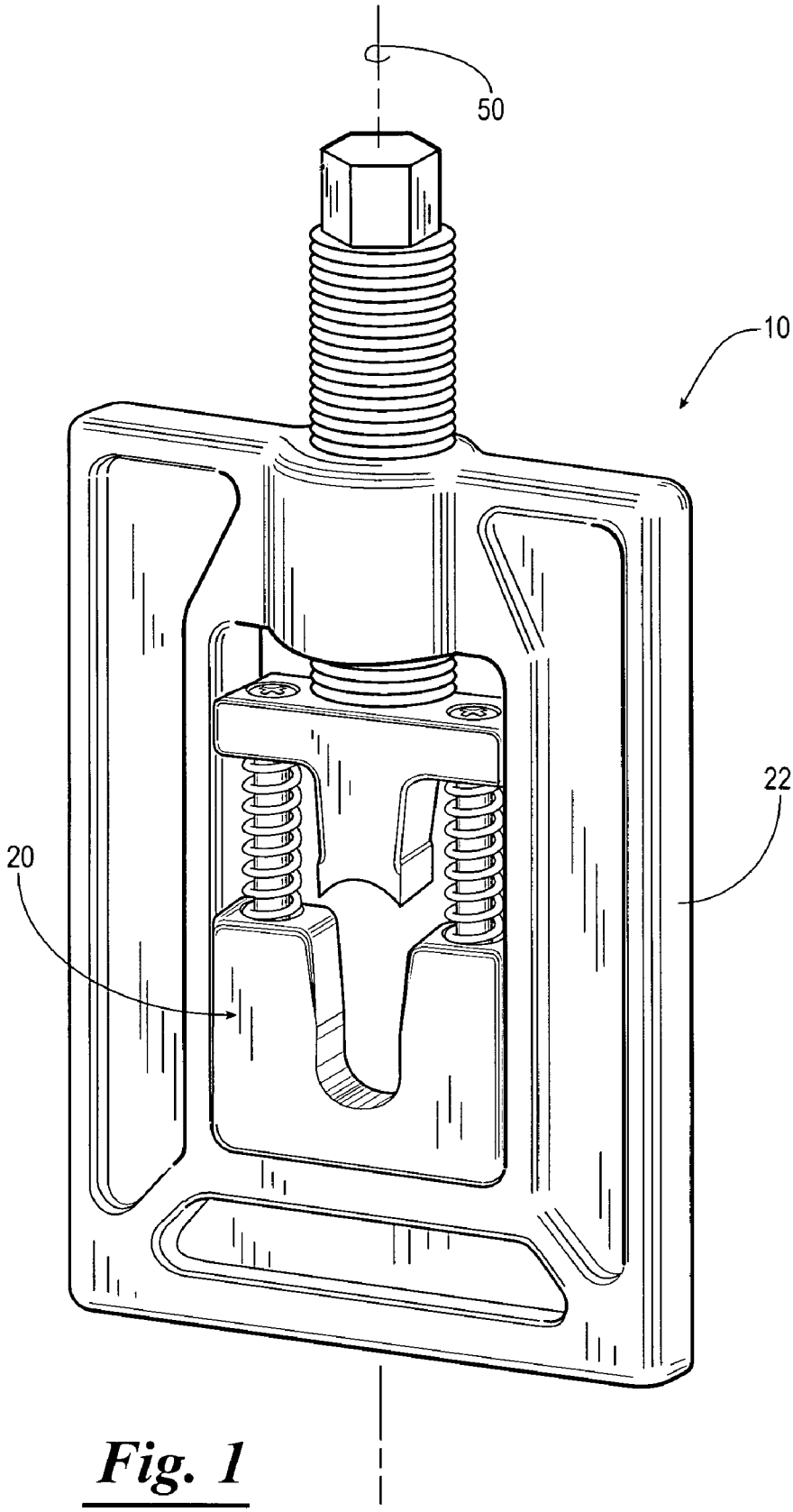
FIG. 1 is a perspective view of a ferrule reducing assembly constructed in accordance with the present invention.
Figure 2:
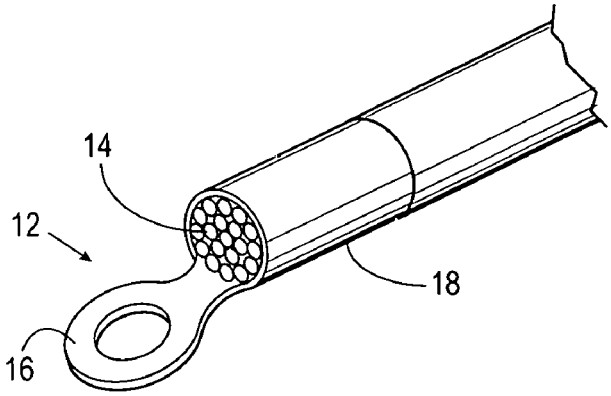
FIG. 2 is a perspective view of an exemplary wire terminal shown positioned on an end of an exemplary length of wire.
Figure 3:
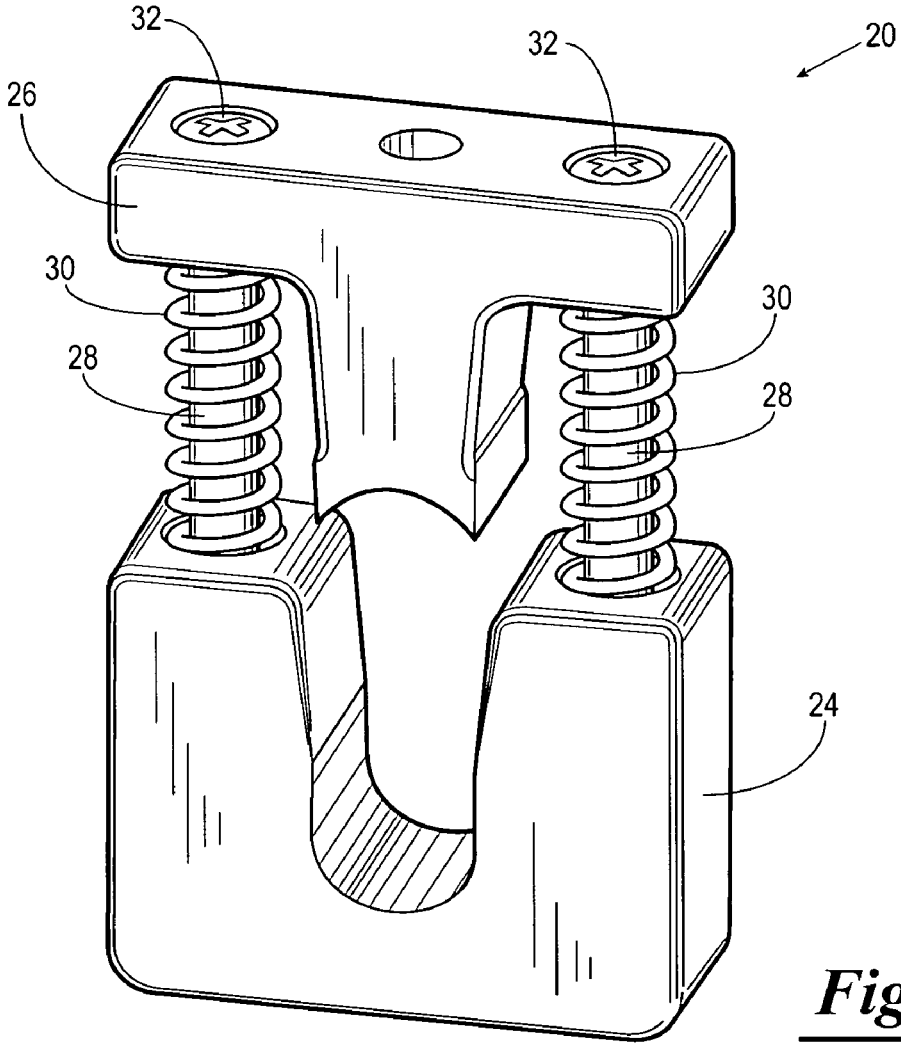
FIG. 3 is a perspective view of a die set assembly.

Referring now to the drawings, and more particularly to FIGS. 1 and 2, a ferrule securing assembly 10 constructed in accordance with the present invention is shown in FIG. 1. An exemplary wire terminal 12 is shown in FIG. 2 after having been secured to the terminal end of a group of wires 14 with the ferrule securing assembly 10. The wire terminal 12 shown in FIG. 2 is a standard blade-type connector having a connection portion 16 and a ferrule 18. The wire terminal 12 and the wires 14 are examples of items that may be utilized in accordance with the present invention and are in no way intended to be limiting.

The ferrule reducing assembly 10, as shown in FIG. 1, includes a die set assembly 20 and an actuating assembly 22. The actuating assembly 22 is used to apply force to the die set assembly 20, and the die set assembly 20 controls the geometric process of reducing the ferrule 18 to make the desired connection.

Figure 4:
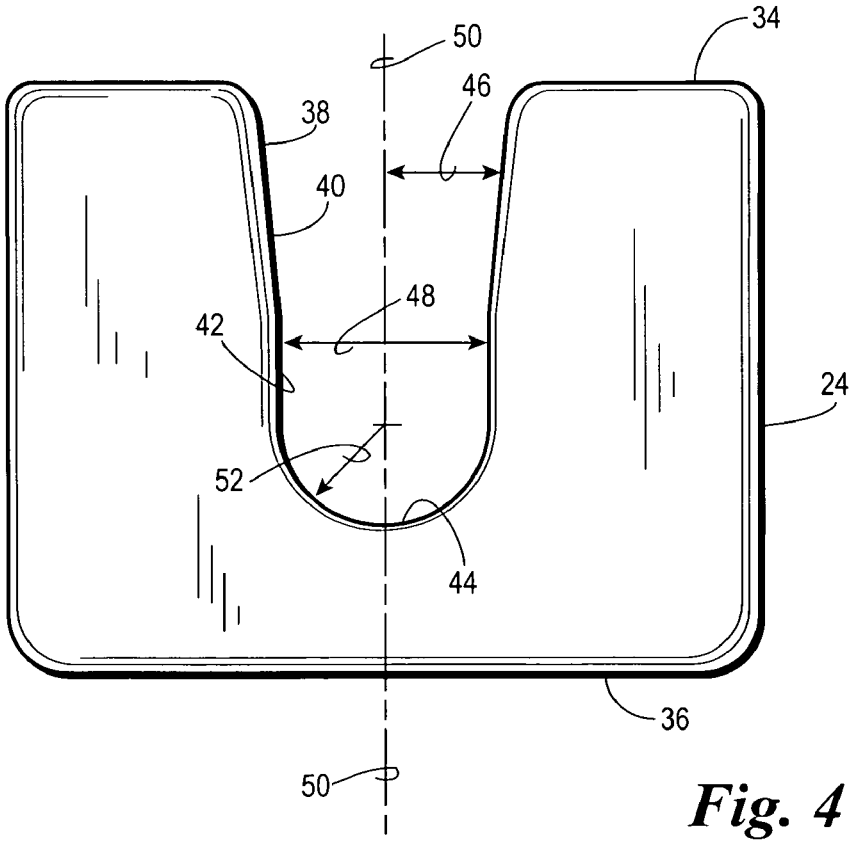
FIG. 4 is a front elevation view of a female die of the die set assembly.

Referring now to FIGS. 3-7, the die set assembly 20 includes a female die 24, a male die 26, guide rods 28, return springs 30, and stop members 32. As best shown in FIG. 4, the female die 24 has a first end 34, a second end 36, and a female die opening 38 extending from the first end 34 toward the second end 36. The female die opening 24 is sequentially defined by a tapered section 40, a parallel section 42, and a concave seat 44. The tapered section 40 is sized to receive a ferrule and decreases in width to transition to the parallel section 42 which terminates at the concave seat 44.

The sequential shaping of the female die opening 24 controls the shape of the ferrule as it is pressed downward by movement of the male die 26. The tapered section 40 forges the ferrule into an oval shape. The parallel section 42 controls maximum reduction of the ferrule width, maximizes the oval transitional shape, and serves to protect male die 26 in a manner to be discussed below. Once compressed against the concave seat 44, the ferrule is then fully contained and controlled by the combined geometry of the female die 24 and the male die 26 and can be reduced to final shape and size.

The tapered section 40 extends from the first end 34 toward the second end 36 with each side of the tapered section 40 angling inward toward an angle 46. The tapered section 40 decreases in width as it extends toward the second end 36 to a width 48. Again, the tapered section 40 functions to forge an initially circularly shaped ferrule into an approximately oval shape prior to the final reduction process being performed. It is necessary that this process be done smoothly without the binding, buckling, shearing, indenting, or otherwise damaging the ferrule. Excessive angles, sharp edges, and over-reducing the ferrule can lead to a failure. Certain tapering angles facilitate the transitional process more reliably than others while keeping the overall size of the die set to a minimum. Although any range of angles for angle 46 might be found to be functional, angle 46 is preferably between about 4 degrees and about 16 degrees, more preferably between about 8 degrees and about 12 degrees, and most preferably about 10 degrees. These ranges of preferred angles may also be expressed as the ratio of unit change in width of the tapered portion per unit change in length of the tapered portion. These ratios are preferably between about 1:15 and about 1:3, more preferably between about 1:7 and about 1:5, and most preferably about 1:5.7.

The tapered section 40 of the female die 24 is shown herein to have straight tapering surfaces. Geometrically straight surfaces, although shown here, are not a requirement to the proper execution of any process or device described in this application. In other embodiments, the opposing sides of the tapered section 40 may be arcuate or otherwise non-linear and may further be concave or convex.

Where the tapered section 40 reduces to the width 48, the female die opening 38 transitions into the parallel section 42. The parallel section 42 preferably has a substantially constant width extending through its length terminating in the concave seat 44. In a manner to be discussed in greater detail below, the parallel section 42 has a length such that a portion of the male die 26 is received in the parallel section 42 upon the ferrule being moved into contact with the concave die seat 44 of the female die 24 to protect the male die 24 from damage.

The concave seat 44 is preferably semi-circular in shape, having a center of curvature located on a central axis 50 and having a radius of curvature designated by the numeral 52. The radius of curvature 52 is preferably equal to one-half of the width 48 such that the sides of the parallel section 42 are tangential to the curve of the concave seat 44.

Figure 5:
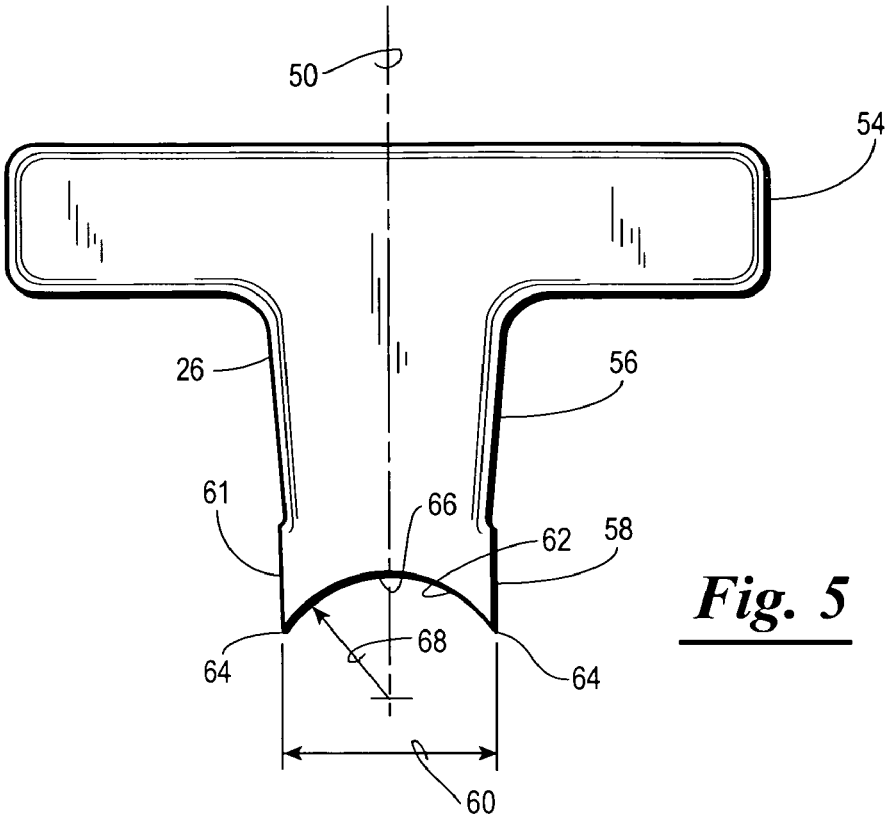
FIG. 5 is a front elevation view of a male die of the die set assembly.

With reference to FIG. 5, the male die 26 has a base portion 54 and a protrusion portion 56 so as to form a substantially T-shaped member. The base portion 54 of the male die 26 preferably has a width equal to that of the female die 24 to receive the guide rods 28 in a manner to be discussed below. In other embodiments, the shape and configuration of the base portion 120 may be adapted to function with alternative alignment devices such as those described below.

The protrusion portion 56 extends from the base portion 54 and has a generally elongated, tapered shape corresponding to the shape of the tapered section 40 of the female die opening 38 of the female die 24 (FIG. 5). The protrusion portion 56 further has a head 58 that is formed to have a width 60 that is slightly smaller than the width 48 of the parallel section 42 of the female die opening 38 (FIG. 4) to be receivable in the parallel section 42. The head 58 of the male die 26 has two lateral surfaces 61 and a concave die face 62 with two lateral edges 64, a medial area 66, and a radius of curvature 68. The male die 26 is receivable in the female die opening 38 to move the ferrule through the tapered section 40 so as to forge the ferrule into a substantially oval shape, to move the oval shaped ferrule through the parallel section 42, and to compress the oval shaped ferrule between the concave die face 62 and the concave seat 44 to forge the oval shaped ferrule into a substantially cylindrical shape having a diameter less than the original diameter of the cylindrical ferrule.

The width 60 of the head 58 is slightly narrower than the width 48 of the parallel section 42 of the female die 24, such that the surfaces between the male die 26 and the female die 24 fit advantageously closely, yet are mechanically smooth when moved relative to each other. To this ends, the length of the parallel section 42 of the female die 24 is sufficiently long to provide strength and stability to the head 58 of the male die 26.

The concave die face 62 of the male die 26 contacts the ferrule and applies pressure to reduce the ferrule to final cross-sectional shape and size. The radius of curvature 68 is important to the process of deforming a ferrule such that the shape and the smooth outer surface are maintained as the size is reduced. To this end, if the radius of curvature 68 is too small, e.g., equal to the radius of curvature 52 of the female die 24, the lateral edges 64 may indent the ferrule as it is compressed, creating surface deformations that may increase the ferrule's susceptibility to corrosion and fouling. If this radius of curvature 68 is too large, the ferrule may be undesirably flattened, appreciably changing the shape of the ferrule. The radius of curvature 68 is preferably such that if the lateral edges 64 contact the ferrule in the initial stages of the reduction process, contact between the ferrule and the concave die face 62 is shifted from the lateral edges 64 of the concave die face 62 to the medial area 66 of the concave die face 62 as the ferrule is moved through the tapered section 40 of the female die 24 and being forged into the substantially oval shape. The radius of curvature 68 of the concave die face 62 is preferably between about 5% and about 50% greater than the radius of curvature 52 of the concave seat 48 of the female die 24, more preferably between about 10% and about 25% larger than the radius of curvature 52, and most preferably about 15% larger than the radius of curvature 52. In other embodiments, the shape of the contact surface of the male die 26 may be non-circular, oval, faceted, or any other shape deemed advantageous in controlling the final shape of the finished connection.

Figure 6:
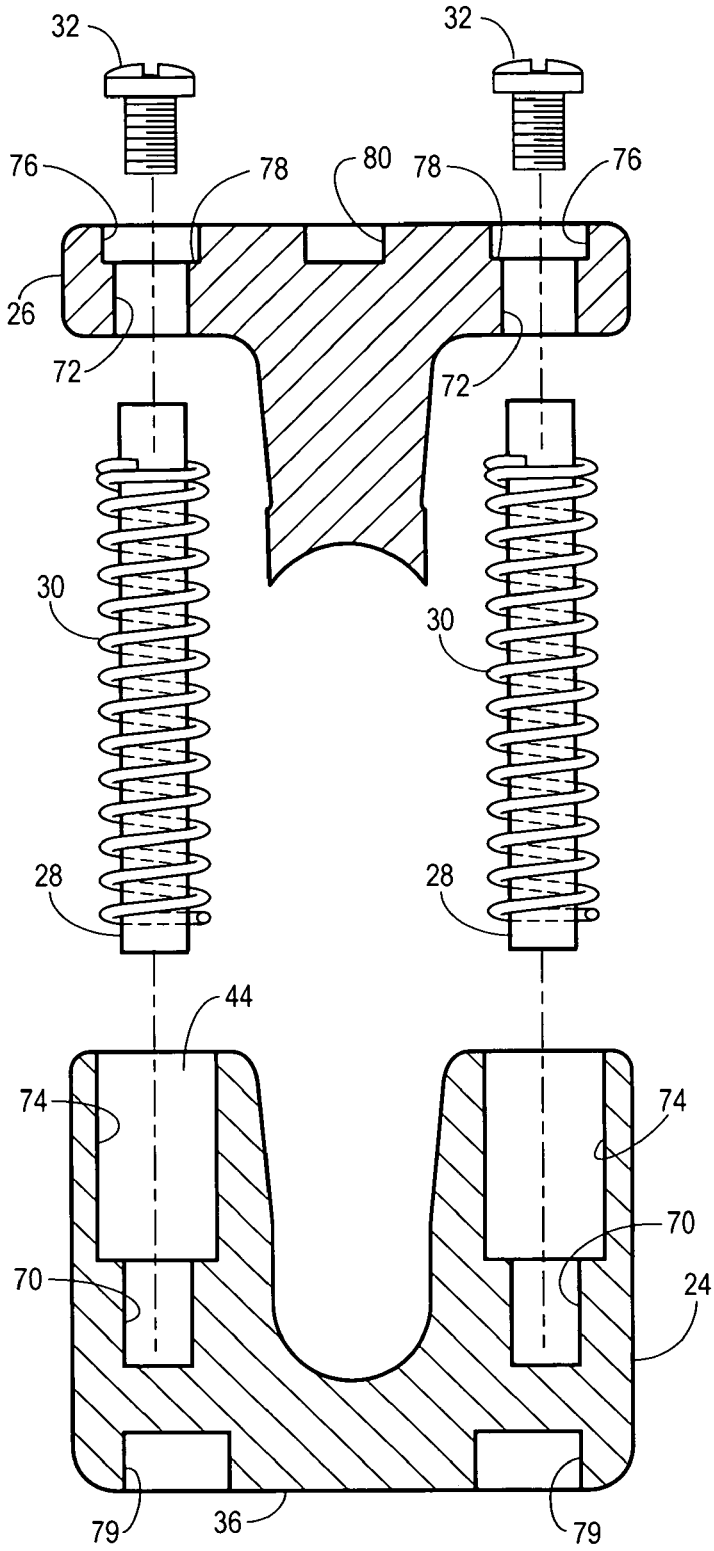
FIG. 6 is an exploded, partially cross-sectional view of the die set assembly.

Referring now to FIG. 6, the female die 24 and the male die 26 are maintained in axial alignment by the guide rods 28 which are affixed to the female die 24 and slidably received in the base portion 54 of the male die 26 to facilitate movement of the male die 26 relative to the female die 24. The guide rods 28 are secured in holes 70 of the female die 24 and are parallel to each other. The upper ends of the guide rods 28 are slidably disposed in holes 72 formed through the base portion 54 of the male die 26 so that the male die 26 is slidable along the guide rods 28. The guide rods 28 are shown to be press fit in the holes 70; however, it will be appreciated that the guides rods 28 may be secured to the female die 26 with screws, welds, adhesive, magnets, or any other suitable fastening means.

The return springs 30 are positioned over the guide rods 28 between the female die 24 and the male die 26 to urge the male die 26 to an open position upon removing a compressive axial force from the male die 26. The female die 24 is provided with counterbores 74 to house the return springs 30 when the male die 26 is compressed relative to female die 24. The male die 26 is provided with counterbores 76 to receive stop members 32. The stop members 32 are shown to be screws that are threaded into the upper end of the guide rods 28 so that a portion of the screws engage shoulder 78 to limit the maximum space between the female die 24 and the male die 26. The lower surface or base portion 54 of the male die 26 is engageable with the first end 34 of the female die 24 to limit the minimum spacing between the female die 24 and the male die 26.

The second end 36 of the female die 24 is provided with a pair of recesses 79, and the male die 26 is provided with a central recess 80. As will be detailed below, each of the recesses 78 and 80 is for receiving a portion of the actuating assembly 12 to maintain the positions of the female die 24 and the male die 26 relative to the actuating assembly 22.

Figure 7:
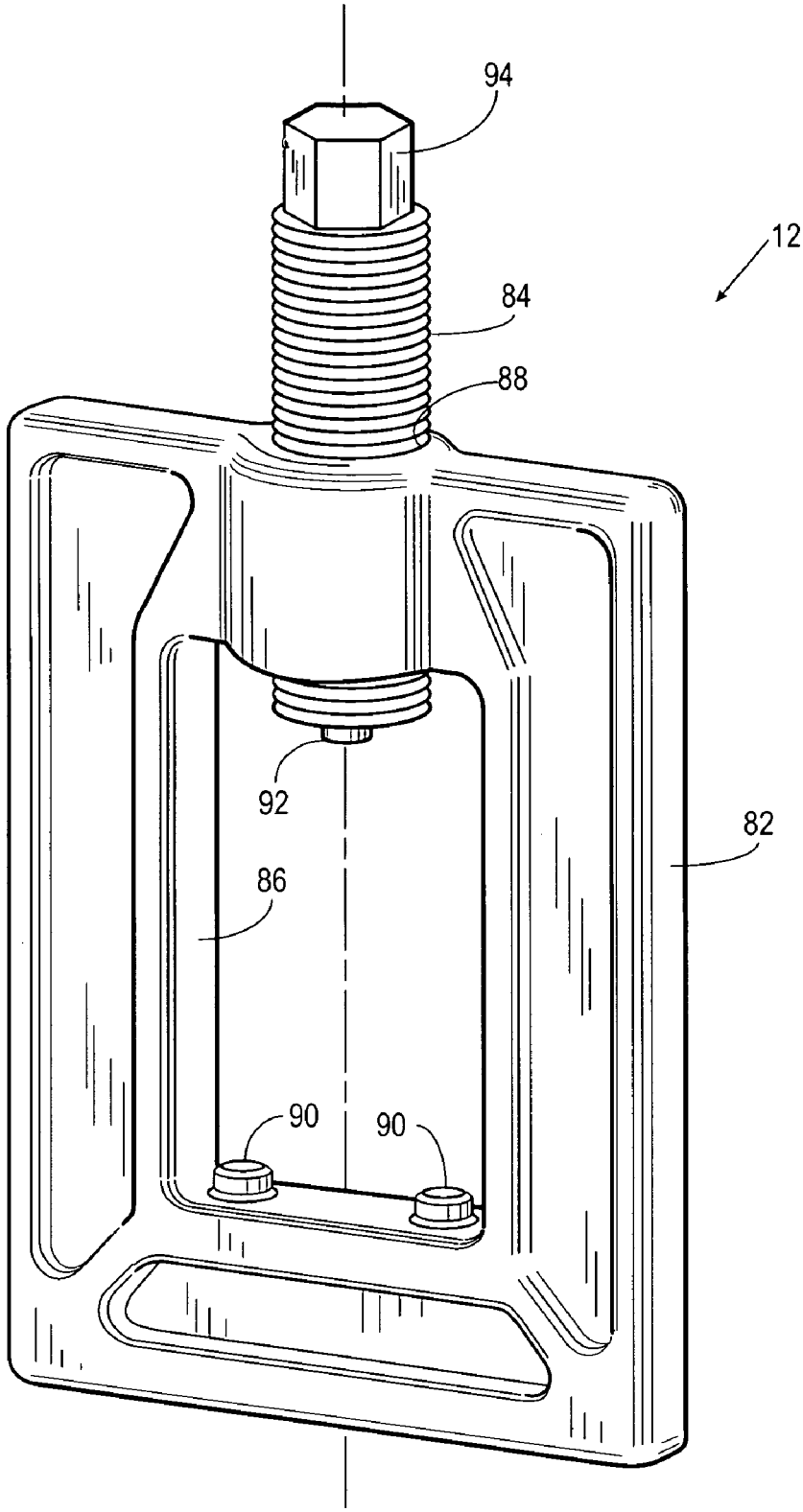
FIG. 7 is a perspective view of an actuating assembly.

Referring to FIG. 7, the actuating assembly 12 includes a frame 82 and a jackscrew 84. The frame 82 has a generally flat, rectangular shape with a die opening 86 sized to receive the die set assembly 20, as illustrated in FIG. 1. The frame 82 is preferably constructed of a rigid, durable material such as steel. The upper end of the frame 82 includes a threaded aperture 88 for receiving the jackscrew 84.

The frame 82 and the jackscrew 84 are provided with alignment pins 90 and 92, respectively, which are receivable in recesses 79 and 80, respectively, to hold the die set assembly 20 in the frame 82. The alignment pins 90 and 92 enable the die set assembly 20 to be loaded into and removed from the actuating assembly 22 quickly and easily and thus allow the die set assembly 20 to be interchanged with a die set assembly of a different size, for example, to accommodate different sized ferrules. It will be appreciated that the alignment pins 90 and 92 and the recesses 79 and 80 may be transposed or substituted with tabs, slots, grooves, or any other means by which the position of the female die 24 and the male die 26 may be maintained relative to the actuating assembly 22.

The jackscrew 84 is threaded so as to provide a high mechanical ratio of rotation to advancement. The advance ratio of the jackscrew 84 aids in keeping the required torque applied to the jackscrew 84 relatively low while applying high compressive forces to the die set assembly 20. The jackscrew 84 has a hexagonal head 94 by which the jackscrew 84 is driven like a bolt using any common wrench or torque wrench.

The actuating assembly 22 described herein represents one manner of actuating the die set assembly 20 with sufficient force to reduce ferrules used in common wiring applications. However, any suitable means of actuation may be used such as hydraulic pistons, gear driven mechanisms, vises, lever-operated mechanisms, and the like, provided the die set assembly 20 is actuated with sufficient force and along the proper plane of motion.

Figure 8:
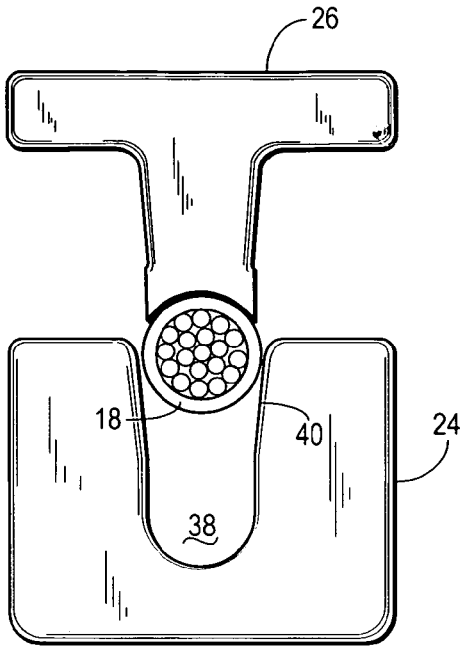
FIG. 8 is a diagrammatical representation of the die set assembly illustrating a ferrule as it is initially positioned between the female die and the male die in an initial stage of the reduction process.
Figure 9:
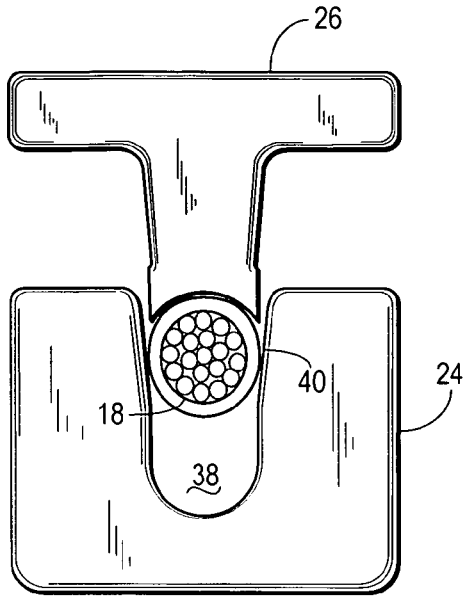
FIG. 9 is a diagrammatical representation of the die set assembly illustrating the ferrule in a medial stage of the reduction process where the ferrule begins to oval in shape.
Figure 10:
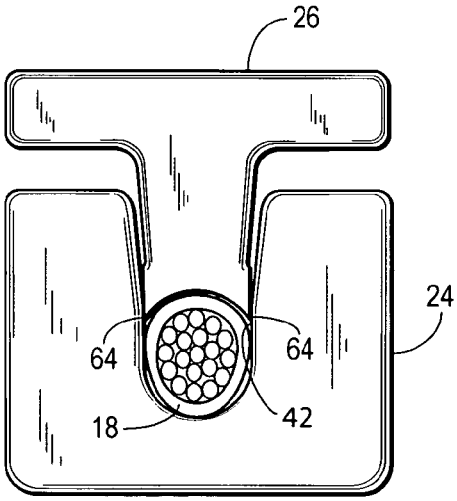
FIG. 10 is diagrammatical representation of the die set assembly illustrating the ferrule as it bottoms in the concave seat of the female die and is reduced to its minimum width and maximum oval shape.
Figure 11:
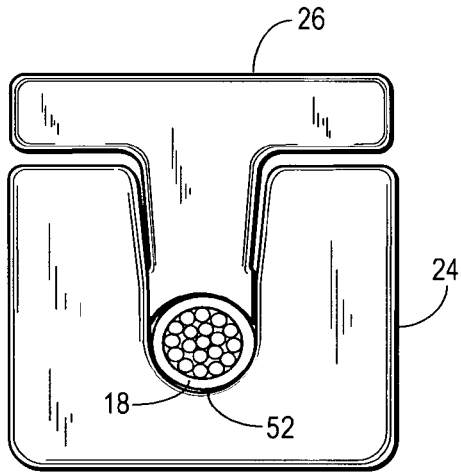
FIG. 11 is a diagrammatical representation of the die set assembly illustrating the ferrule after the male die has completed the reduction process and has restored the ferrule back to a substantially circular shape.

Referring now to FIGS. 8-11, the reduction process is illustrated. FIG. 8 shows a ferrule, such as the ferrule 18, positioned in the upper end of the female die opening 38 prior to a compressive force being exerted by the male die 26. FIG. 9 shows the ferrule 18 being pressed into the tapering section 40 of the female die 24 and the oval transitional shape beginning to take place. FIG. 10 shows the ferrule 18 contacting the concave seat 44 and the lateral edges 64 of the male die 26 positioned within the parallel section 42 of the female die 24. Finally, FIG. 11 shows the ferrule 18 reduced to final cross sectional shape and size.

The reduction process employed by die set assembly 20 includes a medial or transitional state wherein the ferrule is forged into an approximately oval shape by the tapering section 40 of the female die 24. The oval transitional shape eliminates contact between the ferrule and the lateral edges 64 of the male die 26 while the male die 26 is under load. When forming the final cross-sectional shape of the ferrule, the oval state also facilitates a simple secondary transition back to a substantially circular shape.

With the ferrule 18 positioned into the upper end of the female die opening 38, movement of the male die 26 toward the female die 24 initially results in contact between the lateral edges 64 of the male die 26. The gradual tapering geometry of the tapering section 40 enables the loads required to press the ferrule 18 into the tapering section 40 to be non-damaging to the ferrule 18 or to the lateral edges 64 of the male die 26. Once moved into the tapering section 40, the ferrule 18 will begin to oval, thus shifting contact between the ferrule 18 and the concave die face 62 from the lateral edges 64 of the concave die face 62 to the medial area 66 of the concave die face 62. Again, this is important to proper operation of the die set assembly 20, as any substantial load between the lateral edges 64 and the ferrule 18 may crease or buckle the ferrule 18 and may damage the male die 26.

The parallel section 42 of the ferrule die 24 controls the maximum degree of ovaling in the transitional state of the ferrule and has an effect on the final amount of reduction of the cross-section of the ferrule. In addition, the surfaces of the parallel section 42 contain and protect the lateral edges 64 of the male die 26 from bending or breaking when under the high loads encountered during the final reducing process.

It should be understood that although the present embodiment of the invention does include a parallel section 42, the parallel section 42 may be omitted in alternate embodiments. By omitting the parallel section 42, however, the die set assembly 20 will be unable to work over any useful range of cross-sectional areas and will be constrained to only working on a discreet size of ferrule. Also, omitting the parallel section 42 exposes the lateral edges 64 of the male die 26 to high forming pressures without the protection of being laterally captured between parallel surfaces of the parallel section 42, thereby leading to premature failure of the male die 26.

It should be noted that the substantially circular final shape of the reduced ferrule 18, in most embodiments, will not be perfectly circular. The radius of curvature 68 of the concave die face 62 is greater than the radius of curvature 52 of the concave seat 44 so that a perfectly circular final shape is precluded. The design intent of the present invention is not to produce circular or nearly circular finished connections. Instead, the purpose of the present invention is to produce approximately or substantially circular connections that remain attractive in appearance. Thus, the substantially circular final shape of the reduced ferrule 18 should be understood broadly to incorporate these and other imperfections. However, in the preferred embodiment and most alternative embodiments, the substantially-circular final shape is substantially smooth, such that minimal, if any, sharp deformations or indentations are included. In addition, after completing the reduction process as depicted in FIGS. 8-11, the ferrule 18 may be removed from the female die 24, rotated 180 degrees, reinserted into the female die 24, and another reduction process completed on the same ferrule 24 to improve the symmetry of the shape of the ferrule 18, if desired.

While the preferred embodiment of the invention has been illustrated and described, it will be appreciated that various changes can be made therein without departing from the spirit and scope of the invention.

What is claimed is:

1. A die set for reducing a cylindrical ferrule, comprising:

a female die having a first end, a second end, and a female die opening extending from the first end toward the second end, the female die opening sequentially defined by a tapered section, a parallel section, and a concave seat, the tapered section sized to receive the ferrule and decreasing in width to transition to the parallel section, the parallel section terminating at the concave seat, the concave seat having a radius of curvature; and a male die having a concave die face with at least two lateral edges, a medial area, and a radius of curvature, the male die receivable in the female die opening to move the ferrule through the tapered section so as to forge the ferrule into a substantially oval shape, to move the oval shaped ferrule through the parallel section, and to compress the oval shaped ferrule between the concave die face and the concave seat to forge the oval shaped ferrule into a substantially cylindrical shape having a diameter less than an original diameter of the cylindrical ferrule, the radius of curvature of the concave die face of the male die being greater than the radius of curvature of the concave seat of the female die such that contact between the ferrule and the concave die face is shifted from the lateral edges of the concave die face to the medial area of the concave die face as the ferrule is moved through the tapered section and being forged into the substantially oval shape.

2. The die set of claim 1, wherein the radius of curvature of the concave die face of the male die is between about 5% and about 50% larger than the radius of curvature of the concave die seat of the female die.

3. The die set of claim 1, wherein the radius of curvature of the concave die face of the male die is between about 10% and about 25% larger than the radius of curvature of the concave die seat of the female die.

4. The die set of claim 1, wherein the radius of curvature of the concave die face of the male die is about 15% larger than the radius of curvature of the concave die seat of the female die.

5. The die set of claim 1, wherein the parallel section has a length such that the lateral edges of the concave die face of the male die are positioned within the parallel section of the female die upon the ferrule being moved into contact with the concave die seat of the female die.

6. The die set of claim 1, wherein a width of the tapered section of the female die varies linearly relative to a length of the tapered section.

7. The die set of claim 6, wherein the ratio of unit change in width of the tapered section per unit change in length of the tapered section is between about 1:15 and about 1:3.

8. The die set of claim 6, wherein the ratio of unit change in width of the tapered section per unit change in length of the tapered section is between about 1:7 and about 1:5.

9. The die set of claim 6, wherein the ratio of unit change in width of the tapered section per unit change in length of the tapered section is about 1:5.7.

10. A die set for reducing a cylindrical ferrule, comprising:

a female die having a first end, a second end, and a female die opening extending from the first end toward the second end, the female die opening having a tapered section and a concave seat, the tapered section sized to receive the ferrule and decreasing in width from the first end toward the second end, the concave seat having a radius of curvature; and a male die having a concave die face with at least two lateral edges, a medial area, and a radius of curvature, the male die receivable in the female die opening to move the ferrule through the tapered section so as to forge the ferrule into a substantially oval shape and to compress the oval shaped ferrule between the concave die face and the concave seat to forge the oval shaped ferrule into a substantially cylindrical shape having a diameter less than an original diameter of the cylindrical ferrule, the radius of curvature of the concave die face of the male die being greater than the radius of curvature of the concave seat of the female die such that contact between the ferrule and the concave die face is shifted from the lateral edges of the concave die face to the medial area of the concave die face as the ferrule is moved through the tapered section and being forged into the substantially oval shape.

11. The die set of claim 10, wherein the radius of curvature of the concave die face of the male die is between about 5% and about 50% larger than the radius of curvature of the concave die seat of the female die.

12. The die set of claim 10, wherein the radius of curvature of the concave die face of the male die is between about 10% and about 25% larger than the radius of curvature of the concave die seat of the female die.

13. The die set of claim 10, wherein the radius of curvature of the concave die face of the male die is about 15% larger than the radius of curvature of the concave die seat of the female die.

14. The die set of claim 10, wherein a width of the tapered section of the female die varies linearly relative to a length of the tapered section.

15. The die set of claim 14, wherein the ratio of unit change in width of the tapered section per unit change in length of the tapered section is between about 1:15 and about 1:3.

16. The die set of claim 14, wherein the ratio of unit change in width of the tapered section per unit change in length of the tapered section is between about 1:7 and about 1:5.

17. The die set of claim 14, wherein the ratio of unit change in width of the tapered section per unit change in length of the tapered section is about 1:5.7.

18. A method of reducing a cylindrical ferrule, comprising:

moving the ferrule through a tapered section of a female die opening of a female die with a male die to forge the ferrule into a substantially oval shape, the male die having a concave die face with a pair of lateral edges, a medial area, and radius of curvature; and compressing the oval shaped ferrule between the concave die face of the male die and a concave seat of the female die to forge the oval shaped ferrule into a substantially cylindrical shape having a diameter less than an original diameter of the cylindrical ferrule, the concave seat of the female die having a radius of curvature, wherein the radius of curvature of the concave die face of the male die is greater than the radius of curvature of the concave seat of the female die such that contact between the ferrule and the concave die face is shifted from the lateral edges of the concave die face to the medial area of the concave die face as the ferrule is moved through the tapered section and being forged into the substantially oval shape.

19. The method of claim 18 further comprising:

moving the oval shaped ferrule through a parallel section of the female die, the parallel section being positioned between the tapered section and the concave seat, the parallel section having a length such that the lateral edges of the concave die face of the male die are positioned within the parallel section of the female die upon the ferrule being moved into contact with the concave die seat of the female die.

20. The method of claim 18 further comprising the step of inserting a conductor within the ferrule prior to the step of moving the ferrule through the tapered section.

* * * * *